US007934860B2

(12) United States Patent
Tsao

(10) Patent No.: US 7,934,860 B2
(45) Date of Patent: May 3, 2011

(54) LIGHTING FIXTURE WITH ANGLE ADJUSTMENT ARRANGEMENT

(76) Inventor: Frank Tsao, Cleveland (AU)

( * ) Notice: Subject to any disclaimer, the term of this patent is extended or adjusted under 35 U.S.C. 154(b) by 208 days.

(21) Appl. No.: 12/384,400

(22) Filed: Apr. 3, 2009

(65) Prior Publication Data

US 2010/0254147 A1 Oct. 7, 2010

(51) Int. Cl.
*F21V 21/06* (2006.01)

(52) U.S. Cl. ..... 362/389; 362/269; 362/287; 362/277; 362/426

(58) Field of Classification Search ..... 362/389, 362/269, 287, 274, 418, 422, 423
See application file for complete search history.

(56) References Cited

U.S. PATENT DOCUMENTS 6,764,198 B2 * 7/2004 Chang ..... 362/269
7,431,483 B1 * 10/2008 Lee ..... 362/423
7,775,695 B1 * 8/2010 Rose ..... 362/493

* cited by examiner

*Primary Examiner* — Ali Alavi
(74) *Attorney, Agent, or Firm* — Raymond Y. Chan; David and Raymond Patent Firm

(57) ABSTRACT

A lighting fixture includes a light unit, a supporting frame pivotally coupling with the light unit, and an angle adjustment arrangement including a first gear member provided at the light housing, and a second gear member provided at the supporting arm. The first gear member has a first teething face to match and engage with a second teething face of the gear member. When the first gear member is moved apart from the second gear member, the light housing is adapted to pivotally move with respect to the supporting frame so as to selectively adjust the projecting angle of the light unit. After the projecting angle of the light unit is set, the first gear member is moved back to re-engage with the second gear member to lock up the light unit at the projecting angle.

20 Claims, 5 Drawing Sheets

LIGHTING FIXTURE WITH ANGLE ADJUSTMENT ARRANGEMENT

BACKGROUND OF THE PRESENT INVENTION

1. Field of Invention

The present invention relates to a lighting fixture, and more particularly to a lighting fixture, wherein the light projection angle of the lighting fixture is adjustable.

2. Description of Related Arts

It is always needed to affix some object onto a bracket or platform with a desired angle, for example, to affix a light to a bracket with a predetermined angle to light a particular area. Traditionally, screw and nut are used. For example, a light is affixed by using a screw to install from the hinge through a U-shaped bracket. The end of the screw is tightened up with a nut in order to secure the hinge, and the U-shaped bracket in position. The fixture angle can be adjusted by loosening the nut, and re-tightening the nut for fixing the fixture angle. The problem is: the tightening force for fixing the angle comes from the friction force between the screw, hinge, bracket, and the nut. There are three interfaces, and if either interface loses the friction, the fixture angle will not be kept. It is well know, the friction force is relatively small, and in order to increase friction force, the normal force of the interface must be increased, which means the screw and the nut have to be tightened largely. This introduces inconvenience to adjust the angle. And if the angle is adjusted frequently, the interfaces and the teeth of the screw and the nut will be worn out quickly, and can not work longer. This also request higher quality of the material of the screw, net, hinge and bracket.

To avoid the weakness of the traditional method, it is necessary to develop a new device to affix the object with a desired angle which is not using the friction force.

SUMMARY OF THE PRESENT INVENTION

The main object of the present invention is to provide a lighting fixture with angle adjustment arrangement, wherein the angle adjustment arrangement is adapted to securely retain the light housing at a predetermined projecting angle.

Another object of the present invention is to provide a lighting fixture with angle adjustment arrangement, wherein the projecting angle of the light housing can be selectively adjusted and maintained without loosing any component of the lighting fixture.

Another object of the present invention is to provide a lighting fixture with angle adjustment arrangement, wherein the light housing is pivotally coupled with a bracket via an engagement between two gear members to retain the projecting angle of the light housing.

Another object of the present invention is to provide a lighting fixture with angle adjustment arrangement, wherein the gear members are automatically re-engaged via resilient force to secure retain the projecting angle of the light housing after adjustment.

Another object of the present invention is to provide a lighting fixture with angle adjustment arrangement, wherein the gear members are not easy to wear out to prolong the service life span of the angle adjustment arrangement.

Accordingly, in order to accomplish the above objects, the present invention provides a light unit which comprises:

a light housing having a light opening, and an illuminator operatively supported within the light housing for generating a light beam towards the light opening at a predetermined projecting angle;

a supporting frame comprising a supporting arm for supporting the light housing; and an angle adjustment arrangement, which comprises:

a pivot hinge for pivotally coupling the light housing with the supporting arm;

a first gear member, having a first teething face, supported by the pivot hinge and provided at the light housing; and a second gear member, which is supported by the pivot hinge and is provided at the supporting arm, having a second teething face to match and engage with the first teething face of the first gear member, wherein when the first gear member is moved apart from the second gear member, the light housing is adapted to pivotally move with respect to the supporting frame so as to selectively adjust the projecting angle of the light unit, wherein after the projecting angle of the light unit is set, the first gear member is moved back to re-engage with the second gear member to lock up the light unit at the projecting angle.

These and other objectives, features, and advantages of the present invention will become apparent from the following detailed description, the accompanying drawings, and the appended claims.

DETAILED DESCRIPTION OF THE PREFERRED EMBODIMENT

Figure 1:
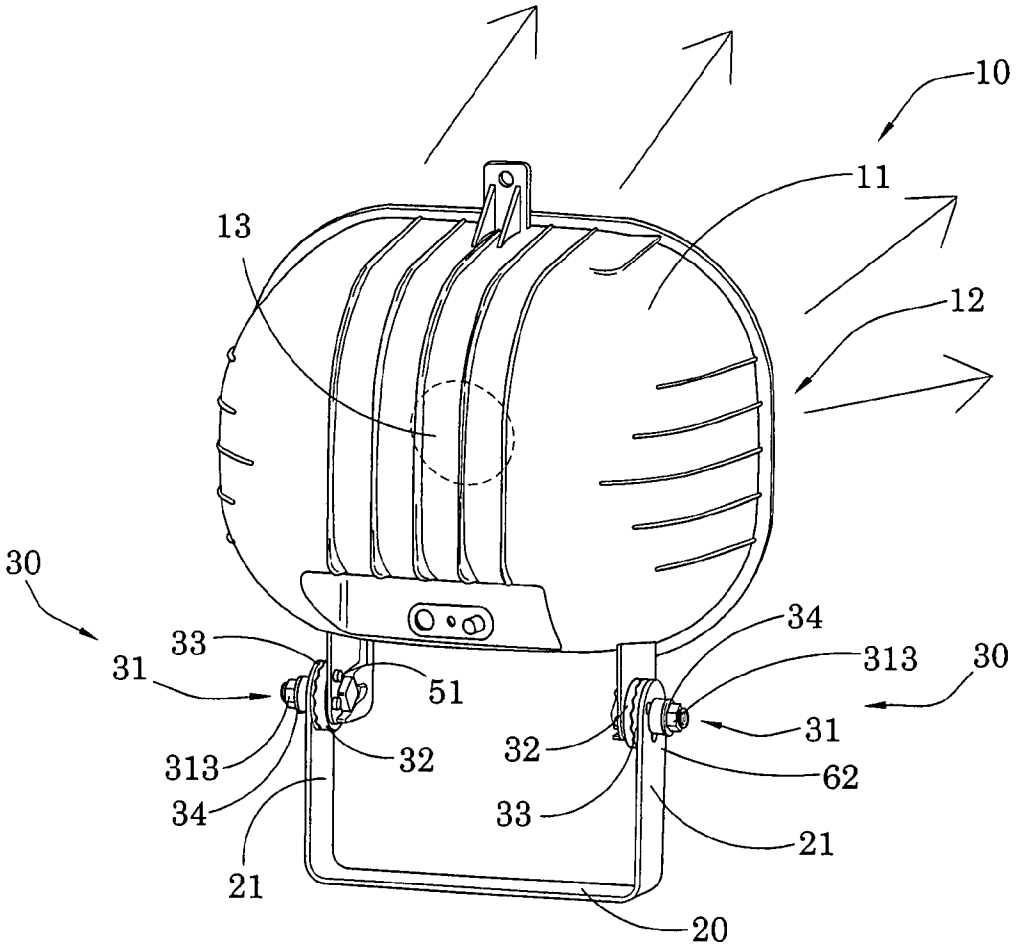
FIG. 1 is a perspective view of a lighting fixture with an angle adjustment arrangement according to a preferred the present invention.
Figure 2:
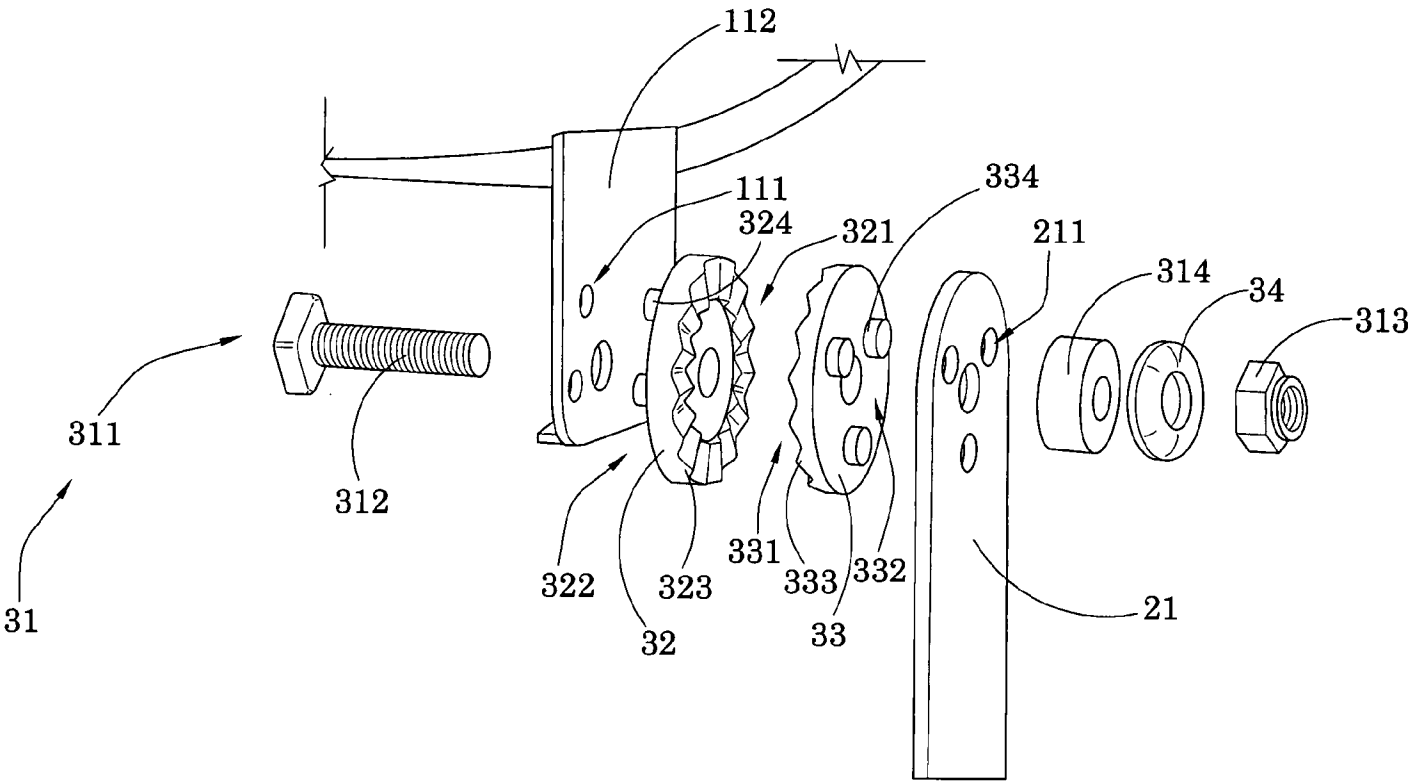
FIG. 2 is an exploded perspective view of the angle adjustment arrangement according to the above preferred embodiment of the present invention.
Figure 3:
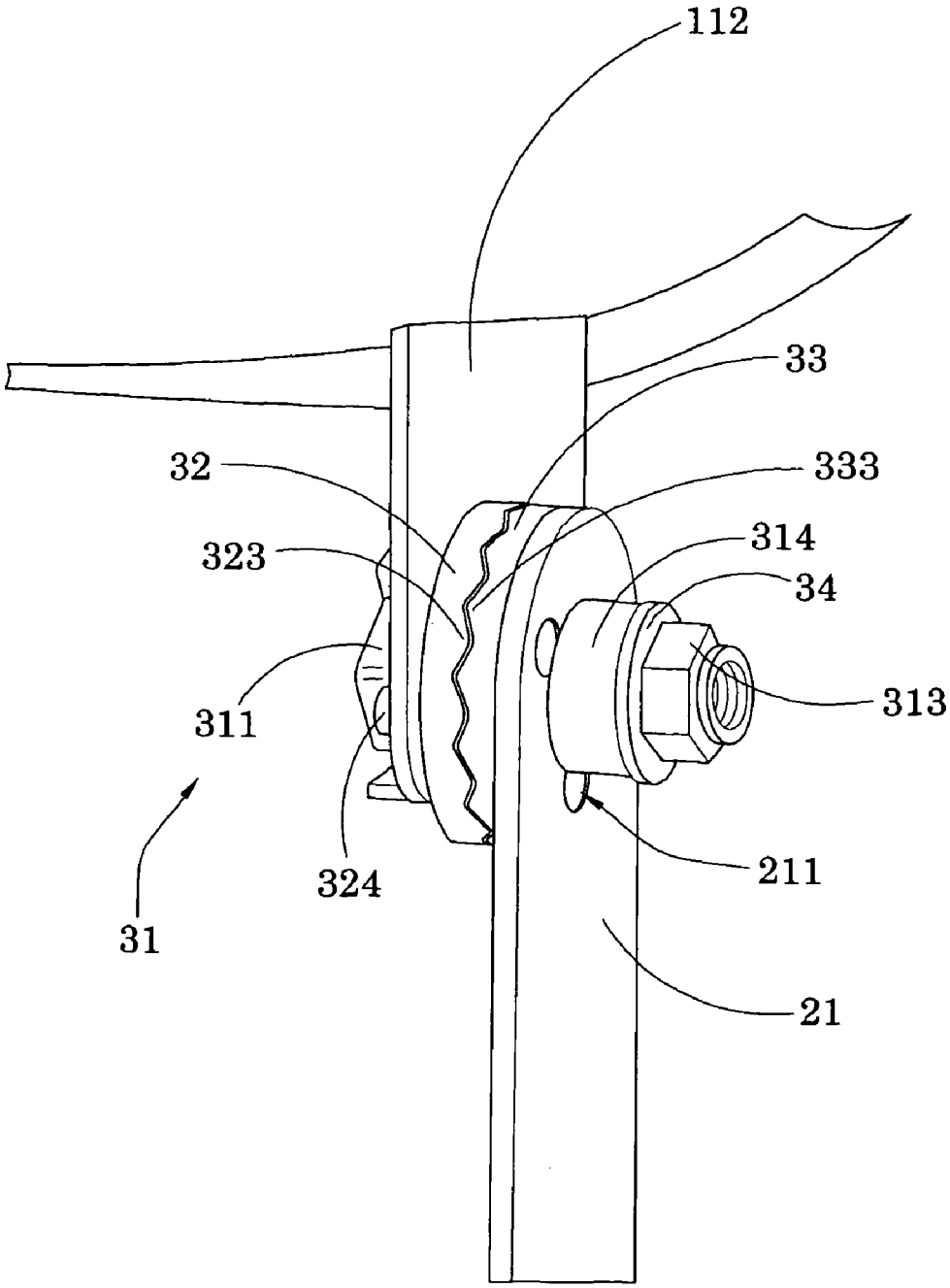
FIG. 3 is a perspective view of the angle adjustment arrangement according to the above preferred embodiment of the present invention.

Referring to FIGS. 1 to 3 of the drawings, a lighting fixture according to a preferred embodiment of the present invention is illustrated, wherein the lighting fixture comprises a light unit 10, a supporting frame 20, and an angle adjustment arrangement 30.

The light unit 10 comprises a light housing 11 which has a light opening 12, and an illuminator 13 operatively supported within the light housing 11 for generating light. The light housing 11 reflects and focuses the light and provides a light beam towards the light opening 12 at a predetermined projecting angle. By adjusting the angle of the light housing 11, the light beam will be projected to a desired direction. The light housing 11 further comprises a housing arm 112 extended downwardly to pivotally couple with the supporting frame 20.

The supporting frame 20 is a frame to support the light housing 11. It also comprises a supporting arm 21 for supporting the light housing 11. Accordingly, the supporting frame 20 comprises a U-shaped bracket having two arm portions extended to pivotally couple with the light housing 11, wherein the supporting arm 21 is defined at each arm portion of the U-shaped bracket. As shown in FIGS. 1 to 5, the supporting arm 21 of the supporting frame 20 is pivotally connected to the housing arm 112 of the light housing 11.

The angle adjustment arrangement 30 is arranged to pivotally connect the housing arm 112 of the light housing 11 with the supporting arm 21 of the supporting frame 20 for adjusting and holding the selected projecting angle.

The angle adjustment arrangement 30 comprises a pivot hinge 31, a first gear member 32, and a second gear member 33. The pivot hinge 31 is used to pivotally couple the housing arm 112 of the light housing 11 with the supporting arm 21. The first gear member 32 and the second gear member 33 are used for adjusting and holding the selected projecting angle.

The first gear member 32 is coupled with the light housing 11, and the second gear member 33 is coupled with the supporting arm 21 of the supporting frame 20. The first gear member 32 and the second gear member 33 are coupled together with an adjustable angle. Then the light housing 11, the first gear member 32, the second gear member 33, and the supporting arm 21 are pivotally integrated together by the pivot hinge 31. In a preferred embodiment of the present invention, the pivot hinge 31 comprises a screw 311 and a nut 312.

Referring to FIGS. 2 and 3, in a preferred embodiment, both the first gear member 32 and the second gear member 33 are in a disk shape having two faces. The first gear member 32 comprises a first teething face 321, and an opposed first connection face 322. The second gear member 33 comprises a second teething face 331, and an opposed second connection face 332. The first gear member 32 further comprises a plurality of first engaging teeth 323 radially protruded from the first teething face 321. Correspondingly, the second gear member 33 also comprises a plurality of second engaging teeth 333 radially protruded from second teething face 331 of the. The first engaging teeth 323 and the second engaging teeth 333 are matched correspondingly. When the first gear member 32 and the second gear member 33 are coupled together coaxially with the first teething face 321 facing the second teething face 331, the first engaging teeth 323 and the second engaging teeth 333 are engaged together to provide a strong force preventing the two gear members 32, 33 to rotate against each other. In this manner, the projecting angle is maintained.

In a preferred embodiment, the light housing 11 has one or more first retention holes 111 spacedly formed at the housing arm 112. Correspondingly, the first gear member 32 further comprises one or more first protruding members 324 outwardly and spacedly protruded from the first connection face 322. The first retention holes 111 and the first protruding members 324 are slidably coupled respectively such that when the projecting angle of the light unit 10 is selectively adjusted, the first gear member 32 is immovably affixed at the housing arm 112 of the light housing 11. Preferably, the first protruding members 324 are small column, and the first retention holes 111 are round through holes with the same diameter of the columns of the first protruding members 324. In other words, when the light housing 11 is pivotally folded with respect to the supporting frame 20 to adjust the projecting angle, the first gear member 32 is correspondingly driven to rotate with respect to the second gear member 33.

Similarly, in a preferred embodiment, the second gear member 33 comprises one or more second protruding members 334, outwardly and spacedly protruded from the second connection face 332. Correspondingly, the supporting arm 21 has one or more spaced apart second retention holes 211. The second retention holes 211 and the second protruding members 334 are slidably coupled respectively such that when the projecting angle of the light unit 10 is selectively adjusted, the second gear member is immovably affixed at the supporting arm 21. Preferably, the second protruding members 334 are small column, and the second retention holes 211 are round through holes with the same diameter of the columns of the second protruding members 334. Therefore, when the light housing 11 is pivotally folded with respect to the supporting frame 20 to adjust the projecting angle, the first teething face 321 of the first gear member 32 is rotatably slid at the second teething face 331 of the second gear member 33.

In other words, the first engaging teeth 323 of the first gear member 32 are moved to re-engage with the second engaging teeth 333 of the second gear member 33 in an alternating manner, so as to retain the projecting angle after every pivotally adjustment.

Figure 4:
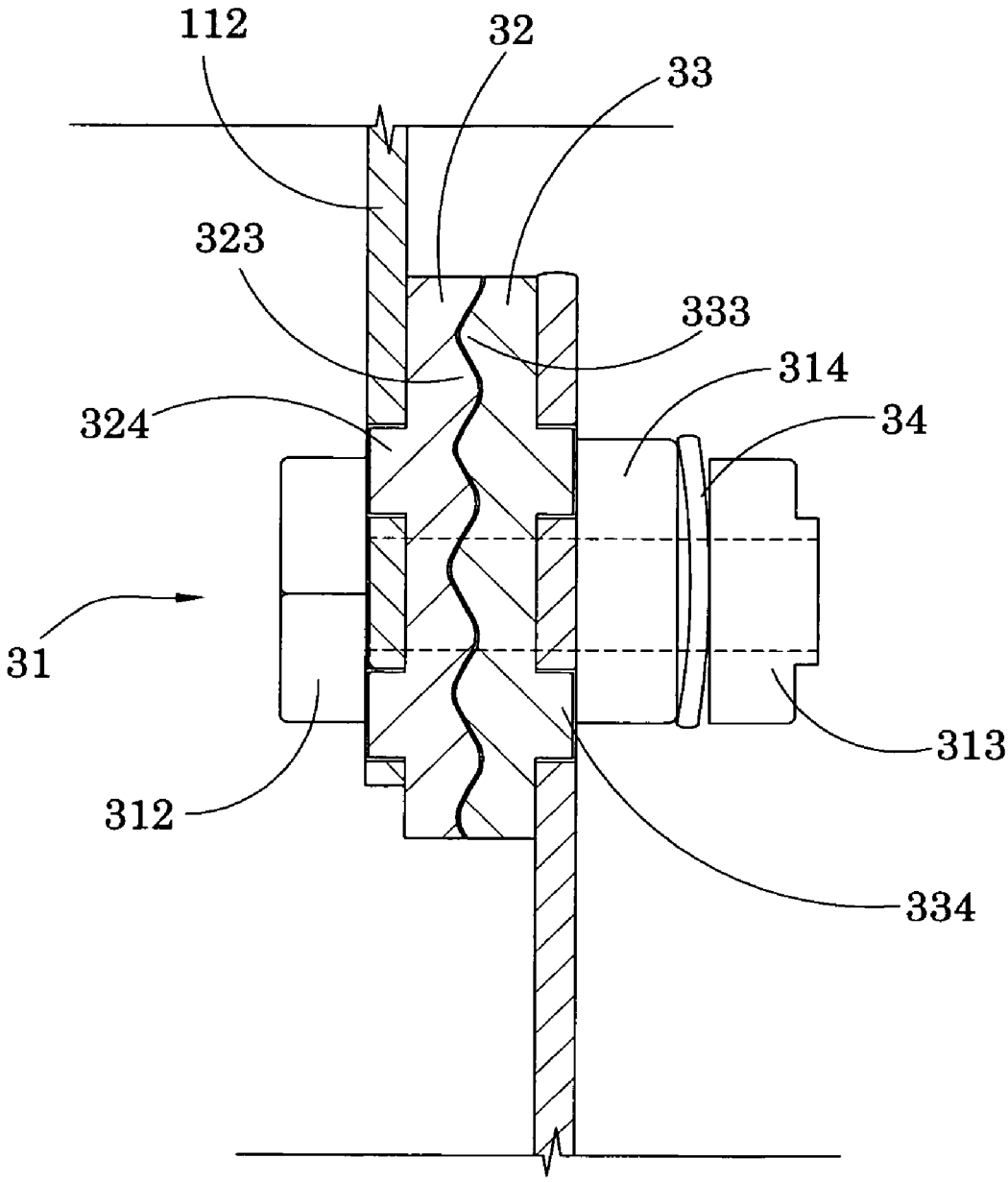
FIG. 4 is a sectional view of the angle adjustment arrangement according to the above preferred embodiment of the present invention, illustrating the first and second gear members being engaged with each other.

The pivot hinge 31 further comprises an axial locker 311 to affix the light unit 10, the first gear member 32, the second gear member 33, and the supporting frame 20 together. In a preferred embodiment, the axial locker 311 comprises a screw 312 and a nut 313. Also, each of the light housing 11, the first gear member 32, the second gear member 33, and the supporting arm 21 has a through hole along the axes of the first gear member 32 and the second gear member 33. The screw 312 is slidably passed through the holes and coupled with the nut 313 at the free end of the screw to affix the light housing 11, the first gear member 32, the second gear member 33, and the supporting frame 20 coaxially. As shown in FIG. 4, the first and second gear members 32, 33 are securely sandwiched between the housing arm 112 and the supporting arm 21 of the supporting frame 20.

To have a better performance, the angle adjustment arrangement 30 also comprises a resilient element 34, which is preferably a spring washer to provide an urging force against the second gear member 33 to ensure the second teething face 331 being re-engaged with the first teething face 321 of the first gear member after the projecting angle of the light unit 10 is set. A flat washer 314 is also used at an outer side of the supporting arm 21. Accordingly, the resilient element 34 is supported by the screw 312 of the axial locker 311 at a position between the supporting arm 21 and the nut 313.

In the manner, the light housing 11 is coupled with the first gear member 32 through the first retention holes 111 and the first protruding members 324 engaged, so there is no relative rotation between them. The supporting frame 20 is coupled with the second gear member 33 through the second retention holes 211 and the second protruding members 334 engaged, so there is no relative rotation between them. The first gear member 32 and the second gear member 33 are couple together through the first engaging teeth 323 and the second engaging teeth 333. The engagement between the teeth maintains the projecting angle. The screw 312 and the nut 313 are fastened to lock the position of the first gear member and the second gear member. To adjust the angle, lose the screw 312 and the nut 313, disengage the first gear member 32 and the second gear member 33 and rotate to change the angle, then fasten the screw 312 and the nut 313 again, a new angle is affixed.

Figure 5:
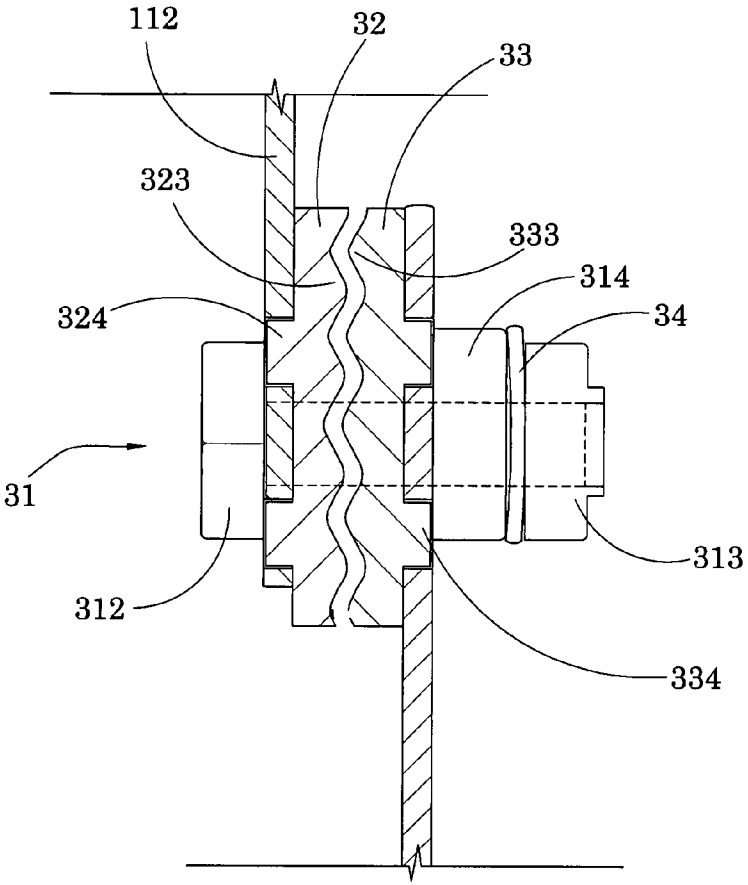
FIG. 5 is a sectional view of the angle adjustment arrangement according to the above preferred embodiment of the present invention, illustrating the first and second gear members being disengaged with each other.

Referring to FIGS. 4 and 5, the resilient element 34 is used, such as a spring washer. The resilient element 34 provides a distance so without losing the screw 312 and the nut 313, the first gear member 32 and the second gear member 33 can be disengaged, and the projecting angle can be adjusted. After adjusting, the second gear member 33 can be pushed towards the first gear member 32 by the resilient element 34 to maintain the adjusted projecting angle.

Accordingly, the resilient element 34 is preferably a Belleville washer which is a non-flat washer. The spring washer has a slight conical shape which provides the washer a spring characteristic, wherein a flexible ability of the resilient element 34 will provide a clearance for the second gear member 33 being disengaged with the first gear member 32.

When the light housing 11 is pivotally folded with respect to the supporting frame 20 to adjust the projecting angle, the first engaging teeth 323 of the first gear member 32 is disengaged with the second engaging teeth 333 of the second gear member 33. As shown in FIG. 5, when the first engaging teeth 323 of the first gear member 32 is disengaged with the second engaging teeth 333 of the second gear member 33, i.e. the first gear member 32 is moved apart from the second gear member 33, the resilient element 34 is forced to become a flat washer. Then, the resilient element 34 will returns to its original form, i.e. the non-flat washer, to apply the spring force at the second gear member 33 so as to ensure the second gear member 33 being re-engaged with the first gear member 32, as shown in FIG. 4. It is worth to mention that deformation of the resilient element 34 must provide enough room for moving the first gear member 32 away from the second gear member 33. In addition, the resilient element 34 can also be a crescent washer, a wave washer, dome washer, or a spiral washer for providing a spring force against the second gear member 33. It is appreciated that the resilient element 34 can be a compression spring coaxially mounted at the screw 312 to bias against the nut 313 so as to apply the spring force towards the second gear member 33. Preferably, the spring washer is used because of its relatively smaller size.

In summary, the arrangement of the present invention eliminates addition cost and adjusts the angle of the fixture in convenience. It avoids using friction force to affix the angle, the manufacture is also very simple. It is worth to mention that the user does not require unlocking the axial locker 311 or loosing the nut 313 from the screw 312 in order to pivotally fold the light housing 11 for adjusting the projecting angle thereof.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighting fixture, comprising:

a light unit which comprises a light housing having a light opening, and an illuminator operatively supported within said light housing for generating a light beam towards said light opening at a predetermined projecting angle;

a supporting frame comprising a supporting arm for supporting said light housing; and an angle adjustment arrangement, which comprises:

a pivot hinge for pivotally coupling said light housing with said supporting arm;

a first gear member, having a first teething face, supported by said pivot hinge and provided at said light housing; and a second gear member, which is supported by said pivot hinge and is provided at said supporting arm, having a second teething face to match and engage with said first teething face of said first gear member, wherein when said first gear member is moved apart from said second gear member, said light housing is adapted to pivotally move with respect to said supporting frame so as to selectively adjust said projecting angle of said light unit, wherein after said projecting angle of said light unit is set, said first gear member is moved back to re-engage with said second gear member to lock up said light unit at said projecting angle.

2. The lighting fixture, as recited in claim 1, wherein said first and second gear members comprise a plurality of first and second corresponding engaging teeth radially protruded from said first and second teething faces respectively, such that when said first teething face of said first gear member is rotated at said second teething face of said second gear member, said first engaging teeth are pushed to disengage with said second engaging teeth and are re-engaged with second engaging teeth in an alternating manner.

3. The lighting fixture, as recited in claim 1, wherein said first and second gear members are affixed to said light housing and said supporting arm respectively in an immovable manner when said light unit is pivotally moved to selectively adjust said projecting angle thereof.

4. The lighting fixture, as recited in claim 2, wherein said first and second gear members are affixed to said light housing and said supporting arm respectively in an immovable manner when said light unit is pivotally moved to selectively adjust said projecting angle thereof.

5. The lighting fixture, as recited in claim 3, wherein said light housing has one or more first retention holes formed thereat, wherein said first gear member further has a first connection face which is opposite to said first teething face, and one or more first protruding members outwardly protruded from said first connection face to slidably couple with said first retention holes respectively such that when said projecting angle of said light unit is selectively adjusted, said first gear member is immovably affixed at said light housing.

6. The lighting fixture, as recited in claim 4, wherein said light housing has one or more first retention holes formed thereat, wherein said first gear member further has a first connection face which is opposite to said first teething face, and one or more first protruding members outwardly protruded from said first connection face to slidably couple with said first retention holes respectively such that when said projecting angle of said light unit is selectively adjusted, said first gear member is immovably affixed at said light housing.

7. The lighting fixture, as recited in claim 4, wherein said supporting frame has one or more second retention holes formed at said supporting arm, wherein said second gear member further has a second connection face which is opposite to said second teething face, and one or more second protruding members outwardly protruded from said second connection face to slidably couple with said second retention holes respectively such that when said projecting angle of said light unit is selectively adjusted, said second gear member is immovably affixed at said supporting arm.

8. The lighting fixture, as recited in claim 6, wherein said supporting frame has one or more second retention holes formed at said supporting arm, wherein said second gear member further has a second connection face which is opposite to said second teething face, and one or more second protruding members outwardly protruded from said second connection face to slidably couple with said second retention holes respectively such that when said projecting angle of said light unit is selectively adjusted, said second gear member is immovably affixed at said supporting arm.

9. The lighting fixture, as recited in claim 1, wherein said angle adjustment arrangement further comprises a resilient element supported at said pivot hinge for applying an urging force against said second gear member to ensure said second teething face being re-engaged with said first teething face of said first gear member after said projecting angle of said light unit is set.

10. The lighting fixture, as recited in claim 4, wherein said angle adjustment arrangement further comprises a resilient element supported at said pivot hinge for applying an urging force against said second gear member to ensure said second teething face being re-engaged with said first teething face of said first gear member after said projecting angle of said light unit is set.

11. The lighting fixture, as recited in claim 8, wherein said angle adjustment arrangement further comprises a resilient element supported at said pivot hinge for applying an urging force against said second gear member to ensure said second teething face being re-engaged with said first teething face of said first gear member after said projecting angle of said light unit is set.

12. The lighting fixture, as recited in claim 9, wherein said pivot hinge comprises an axial locker slidably extended from said light housing to said supporting arm through said first and second gear members to securely retain said first and second gear members between said light housing and said supporting arm so as to enable said light housing being pivotally moved at said supporting arm.

13. The lighting fixture, as recited in claim 10, wherein said pivot hinge comprises an axial locker slidably extended from said light housing to said supporting arm through said first and second gear members to securely retain said first and second gear members between said light housing and said supporting arm so as to enable said light housing being pivotally moved at said supporting arm.

14. The lighting fixture, as recited in claim 11, wherein said pivot hinge comprises an axial locker slidably extended from said light housing to said supporting arm through said first and second gear members to securely retain said first and second gear members between said light housing and said supporting arm so as to enable said light housing being pivotally moved at said supporting arm.

15. The lighting fixture, as recited in claim 12, wherein said resilient element is a spring washer coaxially supported at said axial locker for pushing said second gear member towards said first gear member.

16. The lighting fixture, as recited in claim 13, wherein said resilient element is a spring washer coaxially supported at said axial locker for pushing said second gear member towards said first gear member.

17. The lighting fixture, as recited in claim 14, wherein said resilient element is a spring washer coaxially supported at said axial locker for pushing said second gear member towards said first gear member.

18. The lighting fixture, as recited in claim 15, wherein said axial locker comprises an elongated screw and a nut locking at said screw to pivotally lock up said light housing with said supporting frame in a pivotally movable manner, wherein said first gear member is adapted to move apart from said second gear member to selectively adjust said projecting angle of said light unit via said resilient member without loosing said nut from said screw.

19. The lighting fixture, as recited in claim 16, wherein said axial locker comprises an elongated screw and a nut locking at said screw to pivotally lock up said light housing with said supporting frame in a pivotally movable manner, wherein said first gear member is adapted to move apart from said second gear member to selectively adjust said projecting angle of said light unit via said resilient member without loosing said nut from said screw.

20. The lighting fixture, as recited in claim 17, wherein said axial locker comprises an elongated screw and a nut locking at said screw to pivotally lock up said light housing with said supporting frame in a pivotally movable manner, wherein said first gear member is adapted to move apart from said second gear member to selectively adjust said projecting angle of said light unit via said resilient member without loosing said nut from said screw.

* * * * *